United States Patent [19]

Fränkle et al.

[11] 3,961,611

[45] June 8, 1976

[54] PREHEATING INSTALLATION FOR AIR-COMPRESSING AND AUTO-IGNITING INJECTION INTERNAL COMBUSTION ENGINE

[75] Inventors: Gerhard Fränkle, Grunbach; Roland Klak, Stuttgart, both of Germany

[73] Assignee: Daimler-Benz Aktiengesellschaft, Germany

[22] Filed: Apr. 22, 1974

[21] Appl. No.: 463,133

Related U.S. Application Data

[63] Continuation-in-part of Ser. No. 237,735, March 24, 1972, abandoned.

[30] Foreign Application Priority Data

Mar. 25, 1971 Germany ..... 2114473

[52] U.S. Cl. ..... 123/122 D; 123/122 G; 123/179 H

[51] Int. Cl.[2] ..... F02M 31/00

[58] Field of Search..... 123/179 H, 122 D, 122 G, 123/142.5 R, 122 R; 431/11

[56] References Cited

UNITED STATES PATENTS

| | | | |
|---|---|---|---|
| 2,229,714 | 1/1941 | Wirrer | 123/122 G |
| 2,720,197 | 10/1955 | Titus | 123/122 AB |
| 3,534,723 | 10/1970 | Tramontini | 123/179 |
| 3,626,917 | 12/1971 | Tromel | 123/142 R |
| 3,630,183 | 12/1971 | Hoffman | 122/142.5 R |
| 3,687,122 | 8/1972 | Kamo | 123/122 G |

*Primary Examiner*—Wendell E. Burns
*Assistant Examiner*—David D. Reynolds
*Attorney, Agent, or Firm*—Craig & Antonelli

[57] ABSTRACT

An installation for preheating the combustion air for the multi-fuel operation of air-compressing and auto-igniting injection-type internal combustion engines with poorly ignitable fuels, for example, gasoline, during idling and partial loads, which essentially consists of an injection nozzle for fuel and of a spark plug arranged in the suction pipe. The spark plug and injection nozzle are thereby combined into a structural unit as an insert body which includes a cover structure partially covering the spark plug and the injection nozzle while a protective plate member is provided in the path of the combustion air within the suction pipe for shielding the flame.

25 Claims, 5 Drawing Figures

FIG. 3
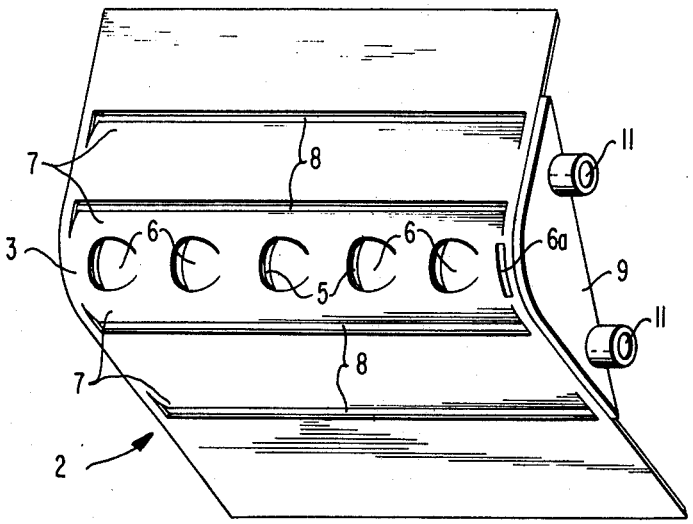
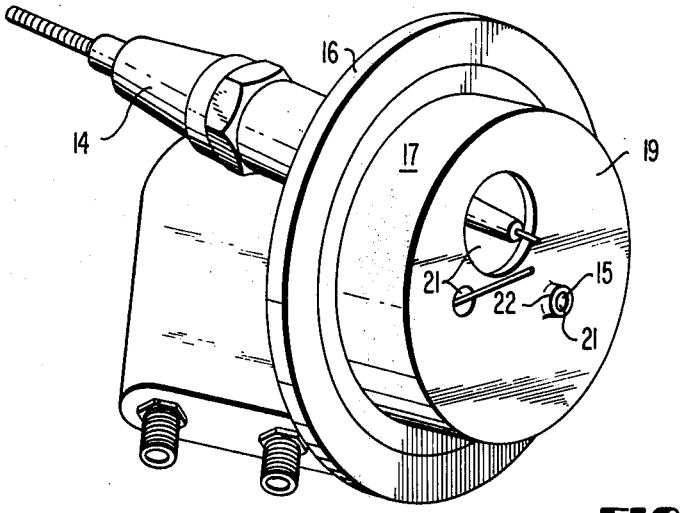
FIG. 4

PREHEATING INSTALLATION FOR AIR-COMPRESSING AND AUTO-IGNITING INJECTION INTERNAL COMBUSTION ENGINE

This application is a continuation-in-part of application Ser. No. 237,735, filed Mar. 24, 1972, now abandoned, which is incorporated herein by reference and the benefit of the filing date is hereby claimed for the common subject matter.

The present invention relates to an installation for the preheating of the combustion air for the operation of air-compressing and auto-igniting injection internal combustion engines with poorly ignitable fuels, for example, gasoline, during idling and partial loads, which essentially consists of an injection nozzle for fuel arranged in the suction pipe and of a spark plug.

The installations utilized heretofore for the multi-fuel operation of the internal combustion engines which effect a preheating of the suction air by the fuel injected into the suction pipe of the internal combustion engine and combusted thereat, satisfy only in part the present-day requirements because the delay-free operation, devoid of failures and breakdowns is not assured, in particular, after changing from Diesel to gasoline operations. The susceptibility to operating difficulties and troubles can be traced back primarily to the unfavorable installation position of the spark plug and of the injection nozzle which do not assure a completely satisfactory ignition and combustion of the fuel.

It is the aim of the present invention to avoid the aforementioned shortcomings by simple means.

Consequently, it is proposed according to the present invention that an insert body, consisting of spark plug and injection nozzle and combined into a structural unit which includes a cover portion covering partially the spark plug and injection nozzle, is secured at the suction pipe within the path of the combustion air and that a protective plate member is arranged at the suction pipe for shielding the flame.

The advantage of the present invention resides, inter alia, in that (a) the spark plug and the injection nozzle, which are combined into a structural unit, are rapidly interchangeable and (b) the cover portion for the insert body protects both the spark plug as also the injection nozzle against sooting and excessive heating.

In an advantageous embodiment of the present invention, the insert body with cover portion and the protective plate may be arranged opposite the central feed of the combustion air.

In a preferred embodiment according to the present invention, the protective plate or sheet metal member can be constructed in a roof-like shape which is closed at the open end faces by webs in order, on the one hand, to reinforce the protective steel plate member and, on the other, to prevent an excessive turbulence of the combustion air between the insert body and the roof-like shaped, protective plate member. This configuration therefore provides a protective member, or hood, for the structural unit of spark plug and injection nozzle, which configuration resembles a trough-shaped member.

A web with spacer members is to be provided as a further feature of the present invention which simultaneously serve as securing elements for the protective member at the housing of the suction pipe.

In order to avoid a soot formation within the area of the insert, especially in front of the discharge aperture of the injection nozzle, the present invention additionally proposes that several nose-like, pressed-out portions provided with slots and arranged one above the other be provided at the bending place, or apex, of the roof-like protective member and that to the right and left of this bending place two slots are provided which are disposed adjacent one another and extend approximately over the entire width of the protective member. Additionally, the bending place may be provided according to the present invention with a slot arranged above the pressed-out portions.

In an advantageous manner, the cover portion may be constructed according to the present invention in a pill box-like configuration and may include a collar-like projection provided on with opening for the injection nozzle and facing the protective member. With poorly discharging nozzles, the projection corrects the jet discharged from the nozzle.

In order to achieve an optimum scavenging and flushing-out within the space between the protective member and the insert body, the present invention additionally provides that the protective member is so arranged in the suction pipe that an air gap results between the housing of the suction pipe and the webs of the protective sheet metal member.

Accordingly, it is an object of the present invention to provide a preheating installation for air-compressing and auto-igniting injection-type internal combustion engines which avoids by simple means the aforementioned shortcomings and drawbacks encountered in the prior art.

Another object of the present invention resides in a preheating installation for air-compressing, auto-igniting injection-type internal combustion engines which fully satisfies all requirements of present-day constructions, particularly as to delay-free and trouble-free operation when shifting from one fuel to another.

A further object of the present invention resides in a preheating installation for internal combustion engines of the type described above which assures a completely satisfactory ignition and combustion of the fuel.

A further object of the present invention resides in a preheating installation for air-compressing, auto-igniting injection-type internal combustion engines which is simple in construction, permits pre-assembly of certain parts, and facilitates the rapid exchange of structural units in case of repairs.

Another object of the present invention resides in a preheating installation for internal combustion engines of the type described above which protects the spark plug as also the injection nozzle both against excessive heat and excessive soiling.

These and further objects, features and advantages of the present invention will become more apparent from the following description when taken in connection with the accompanying drawings which show, for purposes of illustration only, one embodiment in accordance with the present invention, and wherein:

FIG. 3 is a perspective view of a protective sheet metal member provided with several slots; and FIG. 4 is a perspective view of an insert body with a cover portion in accordance with the present invention.

Figure 1:
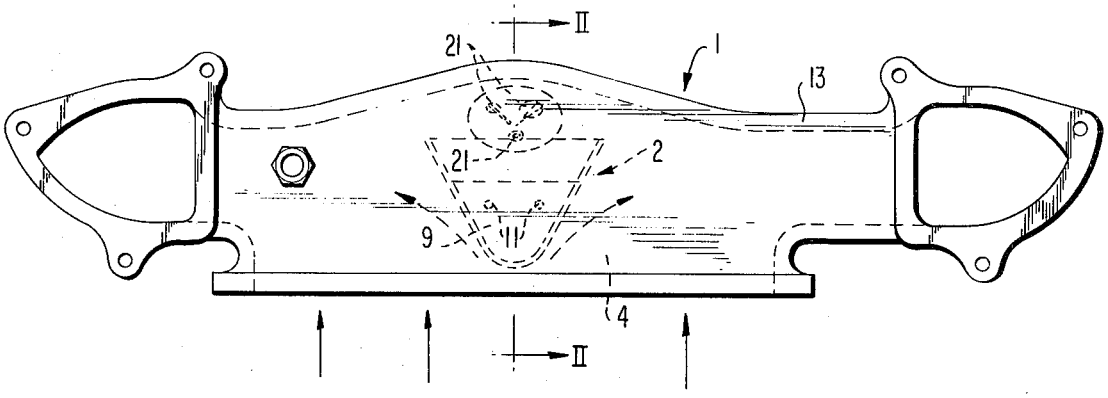
FIG. 1 is an elevational view of a suction pipe structure constructed as distributor in accordance with the present invention.
Figure 2:
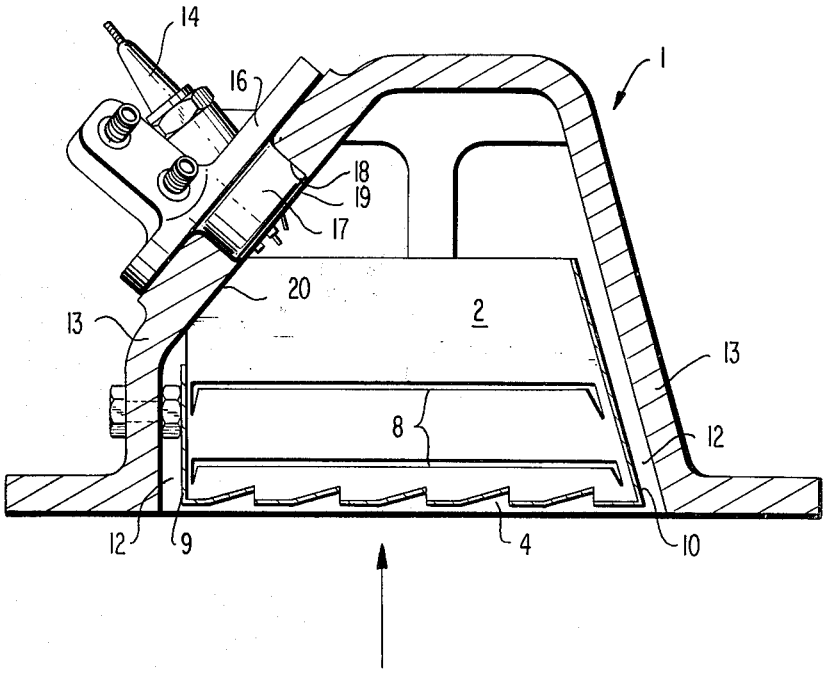
FIG. 2 is a cross-sectional view of the suction pipe taken along line II—II of FIG. 1.

Referring now to the drawings wherein like reference numerals are used throughout the various views to designate like parts and more particularly to FIGS. 1 and 2, a suction pipe generally designated by reference numeral 1, which is constructed as a two-armed distributor, is illustrated in this figure, and is provided for an internal combustion engine with a V-arrangement of two banks of cylinder rows with each cylinder row having, for example, at least two cylinders. The two-armed distributor connects the suction channels connecting the cylinders of each bank of cylinder rows with each other at the end face of the V-arranged internal combustion engine, as generally illustrated in FIG. 5.

Figure 5:
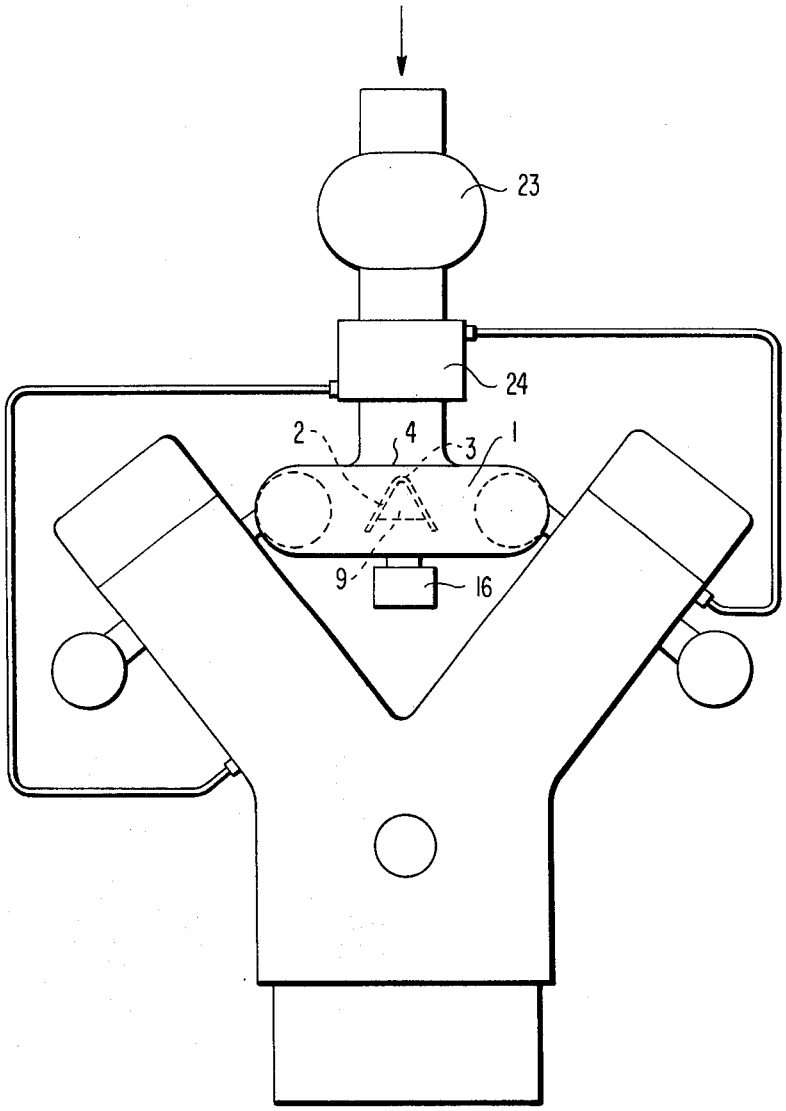
FIG. 5 is a schematic end view showing the arrangement of the present invention in a V-type engine.

Therefore, as may be seen from FIG. 5, the two-arm distributor of suction pipe 1 is arranged symmetrically between the cylinder rows of the V-arrangement, and distributes the preheated combustion air to each of two cylinder rows of the V-arrangement. As is clear from FIGS. 1 and 5, the inlet opening 4 of the two-arm distributor may be located centrally with respect to the two outlet ends of the two-armed distributor, which outlet ends connect respectively to the suction channels of each cylinder row.

A protective plate member generally designated by reference numeral 2 made, for example, of sheet metal, which is constructed, as may be seen in FIG. 3, with a roof-like configuration by bending a sheet metal member along a central dimension to form a V-shape, or roof-shape, with longitudinally extending sides and is arranged centrally, is so arranged in the suction pipe 1 that the bending place 3 (FIG. 3) of the protective member 2 is disposed within the area of the inlet opening 4 (FIG. 1) provided for the intake of combustion air. This protective plate member 2 is provided at the bending place 3 according to FIG. 3 with several nose-like pressed-out portions 6 arranged one adjacent the other along the bending place 3 and provided with slots 5. At the end of the bending place 3 and adjacent these nose-like pressed-out portions 6 is provided a slot 6a which effects a direct in-flow of the combustion air. To the left and right of the bending place 3, the protective sheet metal member 2 is pressed inwardly at two places 7 each in such a manner that slots 8 result thereat with the slots 8 being disposed in a parallel arrangement on both sides of the bending place 3 and extending nearly over the entire width of the protective sheet metal member 2. As mentioned above, the provision of these nose-like pressed-out portions 6 and slots 6a, together with the slots 8, avoid soot formation within the area of insert body 16, and particularly with respect to the injection nozzle 15.

For purposes of reinforcing this roof-like protective sheet metal member 2, two webs 9 and 10 (FIGS. 1, 2 and 3), which are constructed different as regards their size, are arranged at the open end faces of the roof-like configuration, of which the smaller web 9 is provided with two spacer members 11. These spacer members 11 provided with internal threads are so dimensioned in their length that the protective sheet metal member 2 in the installed condition is provided with two identically large, or approximately large, spacings or air gaps 12 between the housing wall 13 of the suction pipe 1 and the web 9 and between the housing wall 13 and the web 10—as can be seen in particular from FIG. 2. As mentioned above, the two webs 9 and 10 thus prevent an excessive turbulence of the combustion air between the insert body 16 and the protective sheet metal member 2.

The insert body 16 consisting of spark plug 14 and injection nozzle 15 and having a cover portion 17 is installed at the housing wall 13 opposite the protective sheet metal member 2. The insert body 16 including its cover portion 17 is inserted into an opening 18 of the housing wall 13 to such an extent that the protective covering wall 19 of the cover portion 17 is flush with the inner wall 20 of the suction pipe 1. Three openings 21 are provided according to FIG. 4 in the protective wall 19 for the spark plug 14 and the injection nozzle 15, of which the aperture for the injection nozzle is provided with a collar-like projection 22 necessary for the injection nozzle 15 and facing the protective member 2.

The combustion air precompressed by a supercharged 23 (FIG. 5) passes at first through a heat-exchanger 24 connected with a cooling water system and from there reaches the suction pipe 1 constructed as distributor and connected therewith. The combustion air guided centrally into the distributor is deflected by the protective plate member 2 serving for the shielding of the flame whereby a portion of the combustion air enters through the slots of the protective sheet metal member 2, is ignited thereat and combusted.

While we have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

What we claim is:

1. An installation for preheating combustion air in a combustion engine using poorly ignitable fuels comprising intake air means mounted between separate cylinder row banks of an engine for distributing combustion air to said separate cylinder row banks of the engine, said intake air means having an inlet opening to pass combustion air into said intake air means, and said intake air means having at least two arms with an opening at the ends of each of said arms connected to said separate cylinder row banks of said engine, said intake air opening being arranged between said at least two arms, and said intake opening being centrally positioned between said separate cylinder row blanks, preheating means mounted on said intake air means substantially opposite said inlet air opening for producing a heating flame to preheat said combustion air, and protective means for shielding said heating flame, said protective means arranged in said intake air means such that said combustion air entering into said intake air means through said inlet opening is deflected by said protection means into respective ones of said at least two arms connected to said separate cylinder row banks, wherein said preheating means comprises a structural unit including a fuel injection nozzle, a spark plug and cover means for partially covering said nozzle and spark plug, said structural unit being inserted into a wall of said intake air means substantially opposite said central inlet opening such that said cover means is flush with said wall.

2. An installation according to claim 1, wherein said separate cylinder row banks include two banks.

3. An installation according to claim 1, wherein said cylinder row banks are disposed in a V-arrangement.

4. An installation according to claim 1, wherein said protective means are formed of a sheet metal member shaped to deflect said combustion air entering into said intake air means.

5. An installation according to claim 4, wherein said sheet metal member is provided with a bend along a central direction, thereby forming a V-shape member with longitudinally extending sides.

6. An installation according to claim 5, wherein said bend has an apex facing said inlet opening.

7. An installation for preheating combustion air in a combustion engine using poorly ignitable fuels comprising intake air means mounted between separate cylinder row banks of an engine for distributing combustion air to said separate cylinder row banks of the engine, said intake air means having an inlet opening to pass combustion air into said intake air means, and said intake air means having at least two arms with an opening at the ends of each of said arms connected to said separate cylinder row banks of said engine, said intake air opening being arranged between said at least two arms, and said inlet opening being centrally positioned between said separate cylinder row banks, preheating means mounted on said intake air means substantially opposite said inlet air opening for producing a heating flame to preheat said combustion air, said preheating means comprising a structural unit including a fuel injection nozzle, a spark plug and cover means for partially covering said nozzle and spark plug, said structural unit adapted to be inserted into a wall of said intake air means substantially opposite said central inlet opening, and protective means for shielding said heating flame, said protective means arranged in said intake air means such that said combustion air entering into said intake air means through said inlet opening is deflected by said protection means into respective ones of said at least two arms connected to said separate cylinder row banks, said protective means being formed of a sheet metal member provided with a bend along a central direction, thereby forming a V-shaped member with longitudinally extending sides, to deflect said combustion air entering into said intake air means, said bend having an apex facing said inlet opening, wherein said V-shape member is closed at each open end face by a web, whereby said webs at each open end face prevents turbulence of said combustion air between said preheating means and said protective means.

8. An installation according to claim 7, wherein the web at one open end face is provided with means for spacing said web from said inlet air means.

9. An installation according to claim 8, wherein a plurality of openings are provided along said bend of said sheet metal member, said openings formed by pressed-out portions of said sheet metal member, and wherein two slot means, each disposed adjacent one another and extending parallel to said bend, are formed in said sheet metal member and disposed on opposite sides of said bend, whereby formation of soot is prevented on said preheating means by said plurality of openings and said slots.

10. An installation according to claim 9, wherein a further slot is arranged at said bend adjacent to said plurality of openings.

11. An installation for preheating combustion air in a combustion engine using poorly ignitable fuels comprising intake air means for distributing combustion air to separate cylinder row banks of the engine, said intake air means having an inlet opening to pass combustion air into said intake air means and at least two arms with an opening at the ends of each of said arms connected to said separate cylinder row banks of said engine, said intake air opening being arranged centrally between said at least two arms, preheating means mounted on said intake air means substantially opposite said inlet air opening for producing a heating flame to preheat said combustion air, wherein said preheating means comprises a structural unit including a fuel injection nozzle, a spark plug and cover means for partially covering said nozzle and spark plug, said structural unit adapted to be inserted into a wall of said intake air means substantially opposite said central inlet opening, and protective means for shielding said heating flame, said protective means arranged in said intake air means such that said combustion air entering into said intake air means through said inlet opening is deflected by said protection means into respective ones of said at least two arms connected to said separate cylinder row banks, wherein said cover means is a pill box-shaped member including a cover and a collar on said cover projecting toward said protective means, said collar including an opening for said fuel injection nozzle.

12. An installation according to claim 11, wherein said preheating means is inserted into said wall of said intake air means such that said cover is flush with said wall.

13. An installation according to claim 7, wherein said protective means is arranged in said intake air means such that an air gap is formed between said intake air means and each web of said protective means.

14. An installation according to claim 1, wherein said combustion air is fed into said inlet opening from a supercharger.

15. An installation according to claim 14, wherein a heat exchanger is connected between said supercharger and said inlet opening.

16. An installation according to claim 1, wherein said combustion engine is an air-compressing, auto-igniting injection internal combustion engine using gasoline as the poorly ignitable fuel.

17. An installation according to claim 11, wherein said protective means are formed of a sheet metal member shaped to deflect said combustion air entering into said intake air means.

18. An installation according to claim 17, wherein said sheet metal member is provided with a bend along a central direction, thereby forming a V-shape member with longitudinally extending sides.

19. An installation according to claim 18, wherein said bend has an apex facing said inlet opening.

20. An installation according to claim 19, wherein said V-shape member is closed at each open end face by a web, whereby said webs at each open end face prevents turbulence of said combustion air between said preheating means and said protective means.

21. An installation according to claim 20, wherein the web at one open end face is provided with means for spacing said web from said inlet air means.

22. An installation according to claim 21, wherein a plurality of openings are provided along said bend of said sheet metal member, said openings formed by pressed-out portions of said sheet metal member, and wherein two slot means, each disposed adjacent one another and extending parallel to said bend, are formed in said sheet metal member and disposed on opposite sides of said bend, whereby formation of soot is prevented on said preheating means by said plurality of openings and said slots.

23. An installation according to claim 22, wherein a further slot is arranged at said bend adjacent to said plurality of openings.

24. An installation according to claim 20, wherein said protective means is arranged in said intake air means such that an air gap is formed between said intake air means and each web of said protective means.

25. An installation according to claim 11, wherein said cylinder row banks are disposed in a V-arrangement.

* * * * *